US008359992B2

(12) United States Patent
Eyre et al.

(10) Patent No.: US 8,359,992 B2
(45) Date of Patent: Jan. 29, 2013

(54) STEERING DEVICE

(76) Inventors: Kevin Philip Eyre, Joondalup (AU); William Gerald Wignall, Lancashire (GB)

( * ) Notice: Subject to any disclaimer, the term of this patent is extended or adjusted under 35 U.S.C. 154(b) by 0 days.

(21) Appl. No.: 12/667,701

(22) PCT Filed: Jul. 1, 2008

(86) PCT No.: PCT/GB2008/002243

§ 371 (c)(1),
(2), (4) Date: Jan. 5, 2010

(87) PCT Pub. No.: WO2009/004323

PCT Pub. Date: Jan. 8, 2009

(65) Prior Publication Data

US 2010/0192826 A1 Aug. 5, 2010

(30) Foreign Application Priority Data

Jul. 5, 2007 (GB) ..... 0713003.2

(51) Int. Cl.
*B63H 25/06* (2006.01)

(52) U.S. Cl. ..... 114/162; 114/165

(58) Field of Classification Search ..... 114/162, 114/163, 165

See application file for complete search history.

(56) References Cited

U.S. PATENT DOCUMENTS

| | | | | |
|---|---|---|---|---|
| 3,838,660 | A | 10/1974 | Frisbee | |
| 4,218,986 | A * | 8/1980 | Hackney | 114/165 |
| 5,114,104 | A * | 5/1992 | Cincotta et al. | 244/219 |
| 2006/0118023 | A1 * | 6/2006 | Howlett | 114/162 |
| 2008/0105183 | A1 | 5/2008 | Santarone | |

FOREIGN PATENT DOCUMENTS

| | | | |
|---|---|---|---|
| EP | 0562780 | A1 | 9/1993 |
| GB | 2414804 | A | 12/2005 |
| WO | 2008016681 | A2 | 2/2008 |

* cited by examiner

*Primary Examiner* — Stephen Avila
(74) *Attorney, Agent, or Firm* — Barlow, Josephs & Holmes, Ltd.

(57) ABSTRACT

A steering device consists of a towed steering surface or blade attached to a marine vessel by means of lines. It provides a method of steering the vessel in fluid. The blade is either rigid or non-rigid and may be supported by a framework. Control of the blade is by an attached lever/quadrant or by lines. Attachment lines and/or control lines can be configured according to the current invention so as to permit a light-weight construction of blade and/or light loads on the helm. The device can be designed as primary steering or as a form of emergency or reserve steering which can be deployed either with or without prior preparation of the vessel.

19 Claims, 6 Drawing Sheets

STEERING DEVICE

Figure 1:
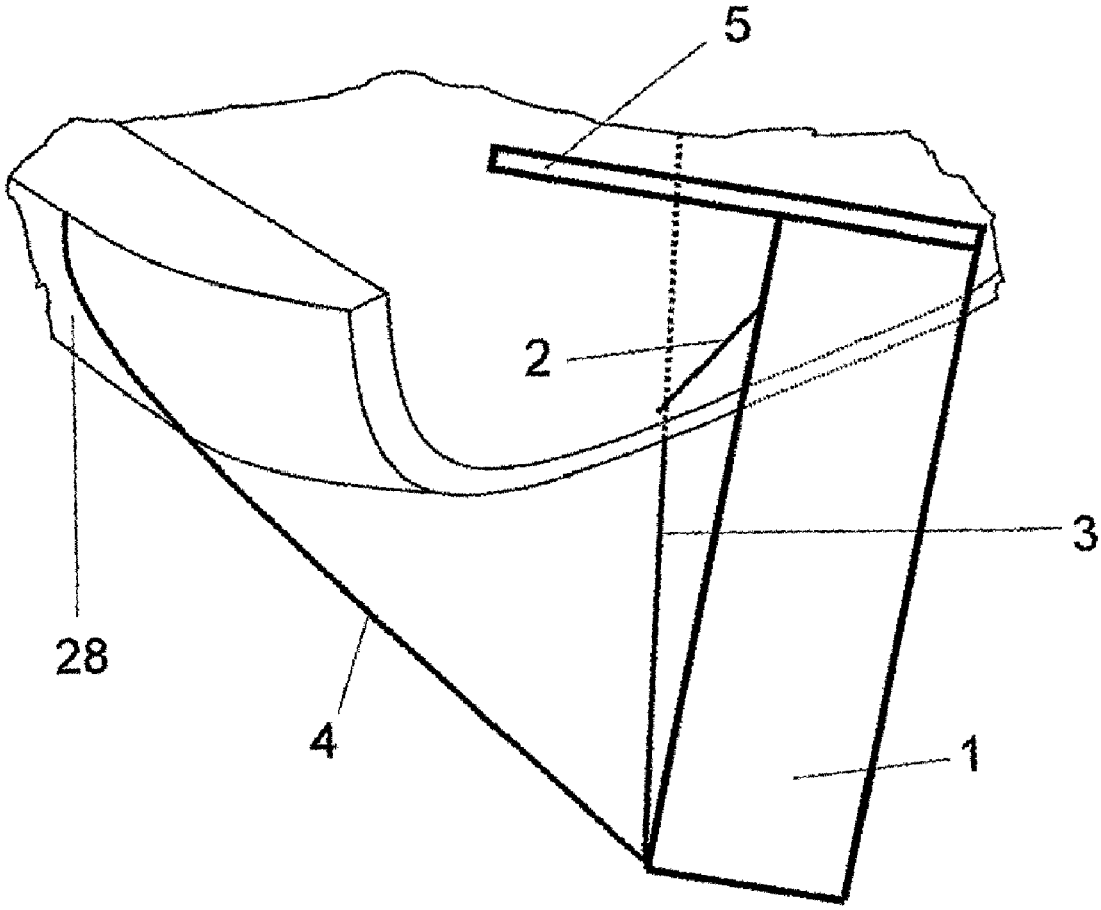

The invention described in this document is a steering device which can provide primary or reserve steering for vessels of a wide range of types and sizes.

Navigation of any vessel in water depends upon effective steering. Damage or loss of steering gear can be catastrophic. Reserve steering control such as an emergency tiller is carried by many vessels and such provision is a requirement of shipping regulations. Few vessels carry any form of reserve rudder even though many vessels are disabled because of damage to the rudder itself rather than its control mechanism. Every year a number of yachts are lost or abandoned because of rudder damage. One reason that few vessels carry a practical emergency or reserve rudder despite the obvious desirability of doing so is that no suitable equipment has been available.

Some vessels carry some form of drogue for use in the event of rudder failure with a view to steering the vessel by means of drag—by altering the athwartships position of the line attaching the drogue to the vessel. In practice such arrangements are seldom satisfactory.

Even where a spare rudder is carried and provision made for it to be deployed from the stem of a vessel—to manoeuvre a solid rudder which may weigh tens of kilograms over the transom of a vessel in a heavy sea before locating onto mountings or into a cassette means that in the course of deployment the reserve rudder is likely to injure the crew and the task may well be impossible.

The instant invention is distinguished from other forms of emergency steering in that it steers by means of lift in the manner of a conventional rudder but is attached to the vessel by lines and may be regarded as being towed somewhat in the manner of a drogue.

Steering of the vessel using the instant invention is effected by a steering surface ('blade') immersed or partly immersed in the water upon which the vessel floats. An essential feature of the invention is that the blade is positioned by at least one and usually two or more lines (referred to below as 'guys', 'ties' or 'control lines' according to function) acting in tension to transfer some or all of the force between the vessel and the blade. The lines connect the blade directly to the vessel—the lines do not connect to a separate post to which is hinged the blade. Lines can be used to control the steering.

The blade can be made of rigid material in the manner of a conventional rudder or include a non-rigid material such as sailcloth suitably supported by a framework.

The vessel is steered using a suitable mechanism to move the blade relative to the vessel in a manner analogous to the control of a conventional rudder. Movement of the blade may be achieved by transfer of torque to the rudder via a tiller, quadrant or similar. Alternatively the blade may be moved by means of adjustment of the geometry of lines. It does not rely upon precise location by means of fixed points at the stem of the vessel. By including lines to transmit steering effort the instant invention can be made in such a manner that it weighs only a fraction of most conventional rigid rudders. Accordingly it can be made easier to stow, easier and less hazardous to deploy than a spare conventional rudder whilst being more effective than alternatives such as a drogue. A single design can easily be deployed on a wide range of vessels without modification.

FIG. 1 shows a version of the device with a rigid blade and attached tiller deployed from the stern of a sailing yacht. The indicated features are:

Blade 1
Tie 2
Guy (starboard) 3

Guy (port) 4
Tiller 5
Vessel 28

Figure 2:
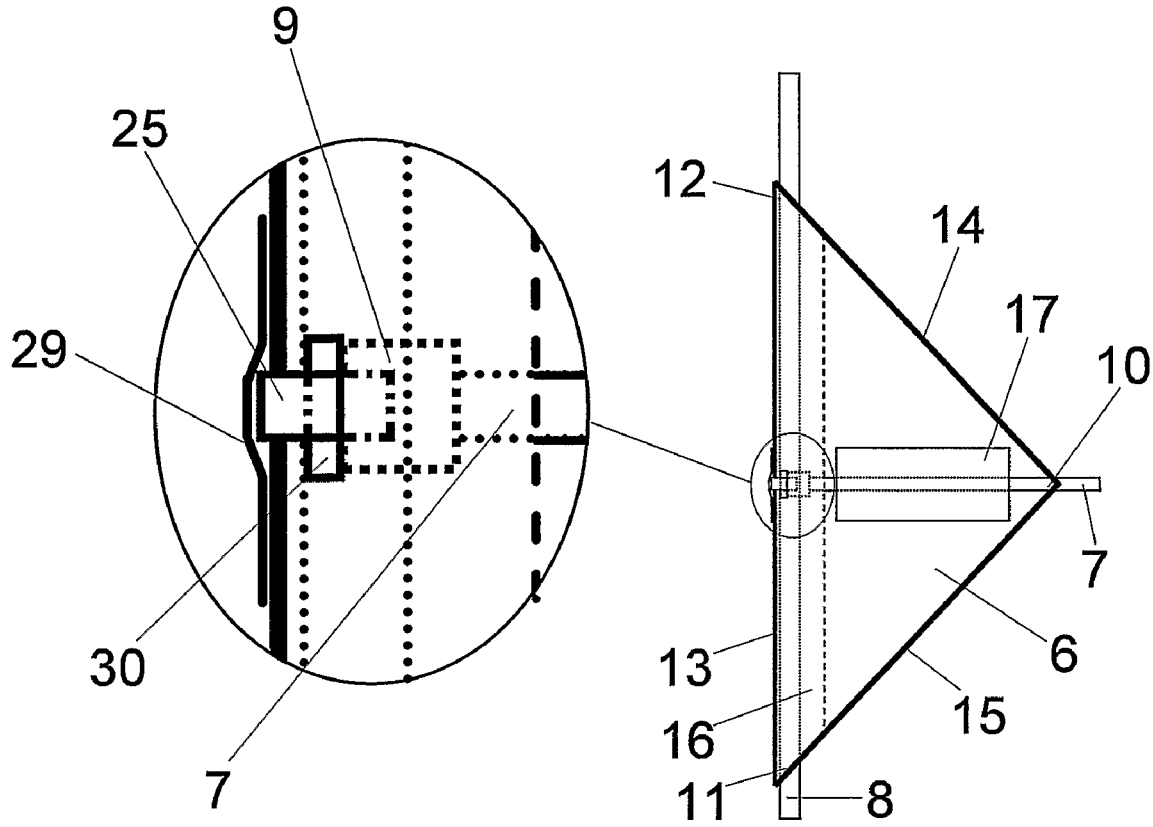

FIG. 2 shows a blade for the device assembled from components including a non-rigid item. Since many of the features of the blade so assembled are analogous to the features of a sailing boat rig terms are adopted as follows:

Sail 6
Boom 7
Pole 8
Gooseneck 9 (rigid in this example)
Clew 10
Tack 11
Head 12
Luff 13
Leech 14
Foot 15
Pole Sleeve 16
Boom Sleeve 17
Gooseneck Retaining Tape 25
Gooseneck Retaining Tape Luff Tape Slot Tape 29
Gooseneck Retaining Tape Slot 30

Figure 3:
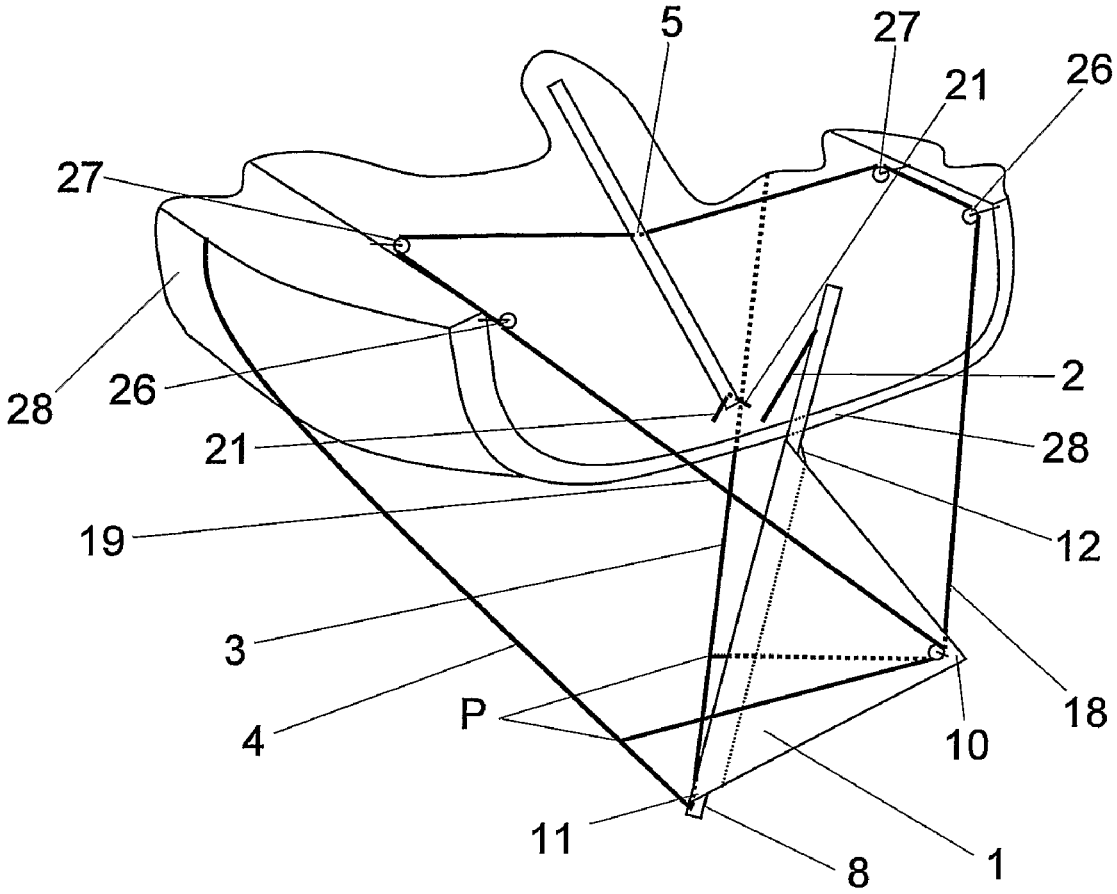
Figure 4:
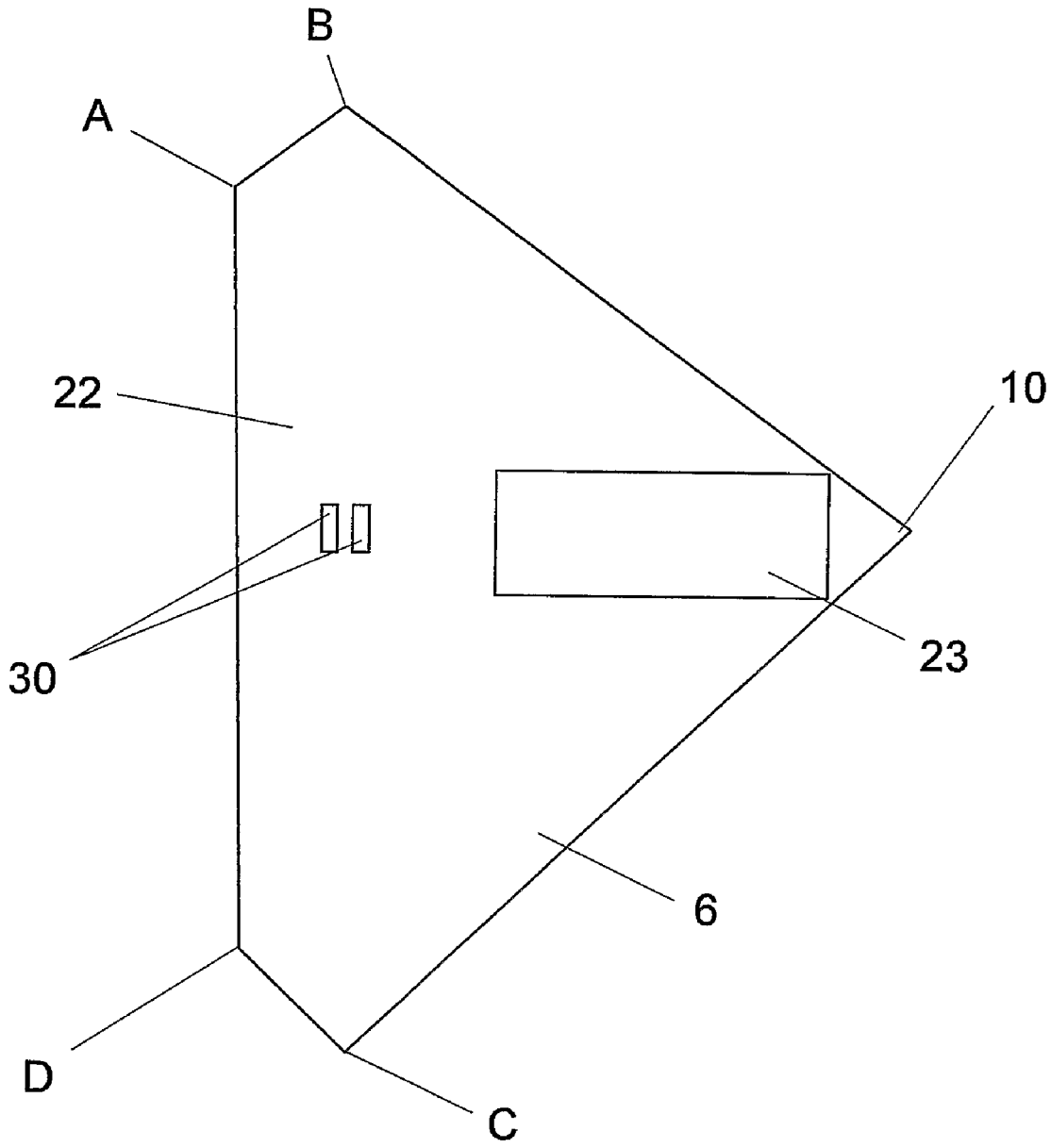
Figure 5:
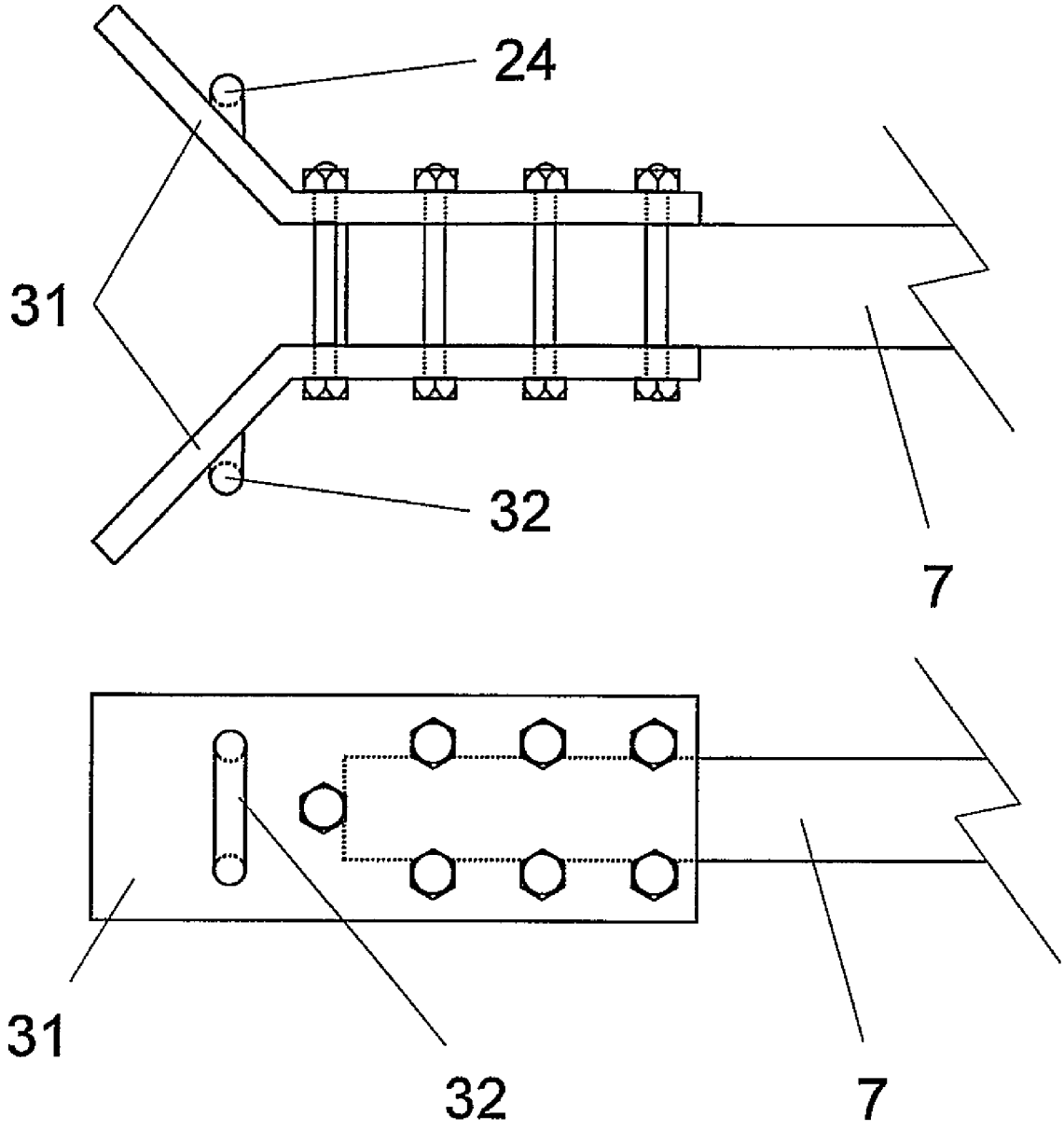

FIG. 3 shows a version of the device with blade according to FIG. 2 deployed from the stem of a sailing yacht attached and controlled entirely by means of lines. The indicated features are:

Blade 1
Tie 2
Guy (starboard) 3
Guy (port) 4
Tiller 5
Pole 8
Clew 10
Tack 11
Head 12
Control Line (starboard) 18
Control Line (port) 19
Tiller Ties 21
Quarter Blocks 26
Tiller Lead Blocks 27
Vessel 28
Control Line/Guy Junction Point P FIG. 4 shows a schematic design for the non-rigid component of a blade designed according to FIG. 2. The indicated features are:

Sail 6
Clew 10
Rectangle for Boom Sleeve 23
Gooseneck Retaining Tape Sail Slot 30
Trapezoid 22 with corners A, B, C and D FIG. 5 shows a design for a gooseneck. The indicated features are:

Boom 7
Gooseneck Retaining Tape Attachment Point 24
Gooseneck Plates 31
Gooseneck Retaining Tape Fastening Point 32

Figure 6:
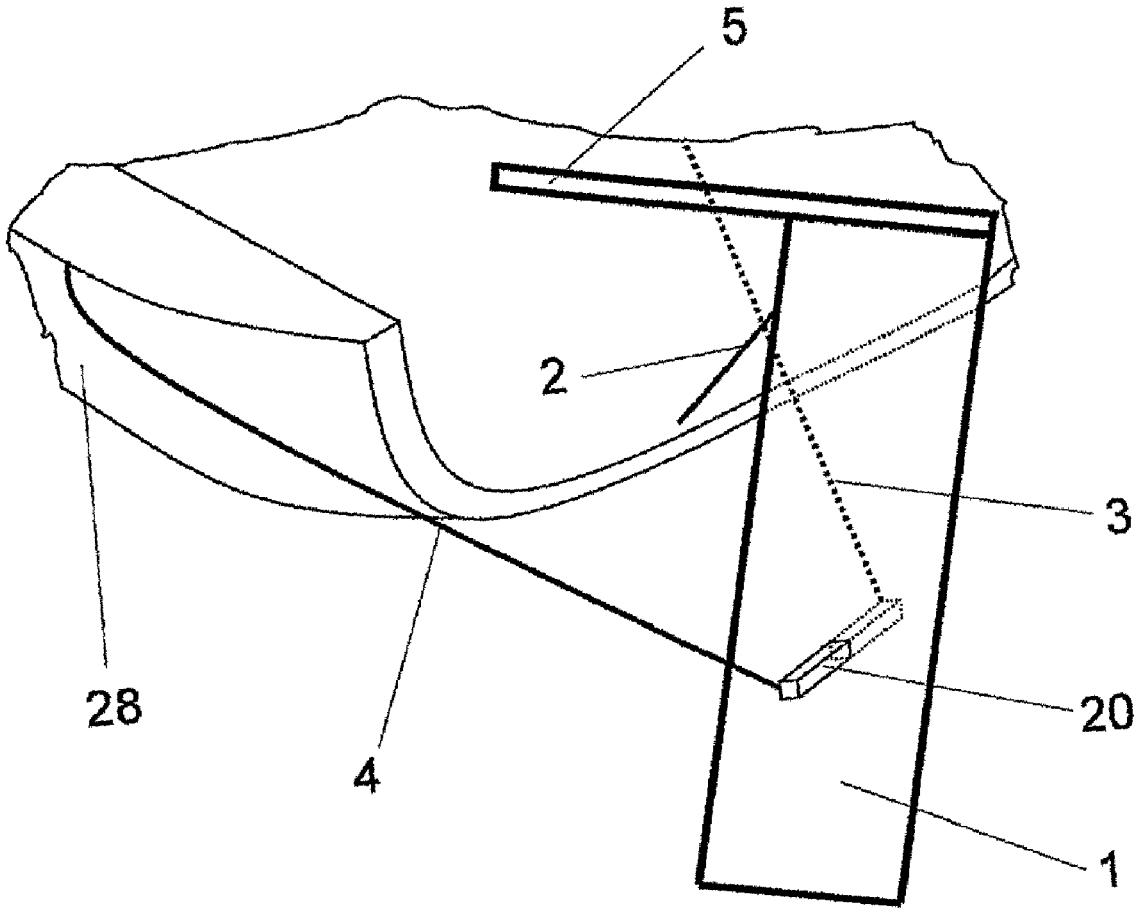

FIG. 6 shows a version of the device in FIG. 1 with provision of outriggers for the guys. The indicated features are:

Blade 1
Tie 2
Guy (starboard) 3
Guy (port) 4
Tiller 5
Guy Outrigger 20
Vessel 28

The device in FIG. 1 is an assembly of blade 1 and tiller 5 similar to that of a conventional transom hung rudder but the blade is attached to vessel 28 by tie 2 and guys 3 and 4. Conventional gudgeons and pintles are not used.

Many variations of the design in FIG. 1 are possible. These include but are not limited to:

i. steering by means of control lines as described below.

ii. attachment of guys above the bottom of the blade and/or aft of the leading edge of the blade. This may introduce balance and thereby reduce load on the helm, better position the device and/or reduce stresses on the system.

iii. attachment of guys to a bridle attached to the blade for the reasons mentioned in ii) or for other reasons such as convenience of manufacture.

iv. attachment of ties from an outrigger/bumkin or to a vertical extension of the blade to allow steering whilst the vessel is moving astern.

v. provision of solid pintle/hinge type fastening instead of one or more lines.

vi. provision of a cradle on the stem or side of the vessel to accept the deployed assembly.

vii. provision of one or more additional guys for the reasons described in ii).

viii. attachment of guys 3 and 4 to guy outrigger 20 provided on each side of blade 1 according to FIG. 6.

ix. an arrangement according to FIG. 6 but with guy outrigger 20 passing through blade 1 protruding equally on both sides of blade 1 and articulated where it passes through blade 1 such that guys 3 and 4 attached at or near their respective ends of outrigger 20 can move along prescribed arcs but cannot move independently of each other.

x. systems employing more than one blade—perhaps using one to turn the vessel to starboard and one to turn the vessel to port.

The blade illustrated by FIG. 2 includes a non-rigid 'sail' 6 which is joined at clew 10, tack 11 and head 12 onto rigid struts boom 7 and pole 8. Boom 7 and pole 8 are joined at gooseneck 9 to form a 'T' shaped frame. Sail 6 is made of sailcloth or other material suitably reinforced. Here constructed with sleeves slid over the struts and/or laced to the struts. The blade is assembled to provide sufficient rigidity. Boom 7 and pole 8 will ordinarily be designed so that they can easily be joined together. They may use a spar or spars which have some other function on the vessel such as a spinnaker pole.

In the device with a blade 1 constructed according to FIG. 2 and deployed according to FIG. 3 guys 3 and 4 are fastened to pole 8 at or near tack 11 and brought under vessel 28 on the starboard and port quarters respectively before being made fast on vessel 28 forward of the blade assembly. Tie(s) 2 are fastened to pole 8 at or above head 12 and are made fast at the stern of vessel 28. Guys 3 and 4 and tie(s) 2 are adjusted to deploy the blade 1 assembly close to the stern of vessel 28 and at a suitable angle. Control lines 18 (starboard) and 19 (port) are taken via blocks at deck level on the quarters of vessel 28 to clew 10. Control lines 18 and 19 can be made fast at clew 10 or returned to vessel 28 to afford a purchase but it is preferred that the control lines are led through blocks at clew 10 and made fast to guys 3 and 4 on their respective sides at point P some distance from where guys 3 and 4 are attached to pole 8. In at least some embodiments of the invention this reduces loading on the helm and improves steering control of the vessel. The steering of vessel 28 is achieved by adjusting the length of control lines 18 and 19.

FIG. 3 shows adjustment of control lines 18 and 19 by means of temporary tiller 5 pivoted on tiller ties 21.

A number of variations of the design outlined in FIGS. 2 and 3 are possible. These include but are not limited to:

xi. use of two booms 7 to form a triangular frame to accept sail 6.

xii. use of two booms 7 passing forward from clew 10 one on each side of sail 6, perhaps socketted into pockets in sail 6 at the level of gooseneck 9 in lieu of a fitting at gooseneck 9. Alternatively these booms could be joined in front of the pole 8 to form a wishbone type boom xiii. constructing blade 1 in such a manner that torsional loads can be transferred and steering by means of a tiller, quadrant or similar attached directly to pole 8.

xiv. fastening of guys 3 and 4 some distance above tack 11 to reduce the bending moments on pole 8 and/or to better position the device.

xv. attachment of guys to a bridle.

xvi. as iv) above.

xvii. as v) above.

xviii. as vi) above xix. as vii) above xx. as viii) above xxi. as ix) above xxii. as x) above Construction assembly deployment and use of a paradigm example of the current invention according to FIGS. 2 and 3 which has been shown to be effective in control of a sailing yacht will be described below in detail with general and particular explanation of the current invention. Any dimensions given are appropriate for a typical yacht in the range 8 metres to 10 metres overall but may well be appropriate for vessels in a wider range of sizes.

A sail 6 is constructed from a heavy grade of sailcloth (380 gm/sq metre polyester). A range of other materials is available. The cloth is cut according to FIG. 4 so that trapezoid 22 can be folded back and sewn to the body of the sail to form the triangular sail shown by FIG. 2 with pole sleeve 16 along luff 13 (the sleeve should be of such size that any appropriate pole 8 can easily pass through). The stitching should be discontinuous part way along luff 13 at the level of gooseneck 9 to admit boom 7. Before stitching the sleeve the luff tape mentioned below is affixed to the sail. A rectangle 17 of the same type of sailcloth is sewn from clew 10 towards luff 13 perpendicular to luff 13 with two parallel rows of stitching such that boom 7 can pass through the resultant boom sleeve 17 from clew 10 to luff 13.

An improvement on the example under consideration could incorporate a luff sock within pole sleeve 16. The luff sock could be made of light sailcloth. Its function would be to guide the passage of pole 8 on assembly of the device. A window could also be cut into pole sleeve 16 to admit boom 7 more smoothly.

The shape of sail 6 is an isosceles triangle with leech 14 and foot 15 each about 60% of the length of luff 13 which is about 1.8 metre. The lateral area of the sail is approximately the same as the area of the permanent rudder of the vessel on which it is deployed. Other examples could adopt almost any substantially triangular sail shape but where one side is only a fraction of the length of the other two function is likely to be significantly compromised. Usually the area of lateral resistance of sail 6 will be in the range 60% to 150% of that of the vessels own rudder. Non-triangular shapes could be adopted. Stiffening devices such as battens could be employed. An entirely solid blade could be used.

All three edges of sail 6 are reinforced with high strength tape sewn along the edges according to FIG. 2. Tapes are sewn along both sides of leech 14 and foot 15. The tapes are joined and formed into strong loops at least 12 mm diameter at all three corners. At tack 11 two further loops of tape (not shown) are securely attached either side of the first loop. Each of these loops is approximately 25 mm in diameter. A short piece of tape 29 is fastened along the tape on luff 13 at the level of gooseneck 9 securely sewn at each end to form a slot between the two layers of tape such that a tape can pass perpendicularly through the slot as a snug sliding fit. On both sides of this slot a vertical slot 30 is cut in sail 6 such that a tape can pass through pole sleeve 16. The current example of the invention employed 25 mm spectra tape which was found satisfactory for all these applications but very large yachts might require a heavier tape and/or multiple layers of tape.

A boom 7 assembly is constructed from materials suitable to withstand the marine environment. A 20 mm×12 mm glass-fibre sail batten was used and has been found to make a suitable boom 7 but large yachts may use larger sections, multiple battens and/or other materials. Other methods of tensioning the clew could be employed but with the system used by the current example the length of boom 7 is at least equal to the perpendicular distance from luff 13 to clew 10 less the minimum diameter of pole 8 plus sufficient length to accommodate the attachment points (referred to below) including sufficient length for a lanyard to tension clew 10. It is not necessarily disadvantageous for boom 7 to be longer than the minimum as this will give increased leverage but at a cost of reduced movement particularly at the limits. A small excess of boom 7 length will be trivial in its effect on performance of the present invention. Some applications may deliberately opt for a longer than minimum boom for the advantage given by extra leverage, for example in avoiding the need for a multiple purchase.

A stainless steel gooseneck 9 according to FIG. 5 is formed from two plates of 3 mm thickness 150 mm length and 50 mm width. The plates are bent at a 45 degree angle 50 mm from one end. Two rows of three 5 mm holes are drilled in the 100 mm section of each plate such that they can be bolted together securely clamping the boom between them. The plates are fastened over boom 7 with their 50 mm bent sections diverging. A seventh 5 mm hole is drilled in the 100 mm section of each plate just behind the bend in the plates half way between the two rows of holes and a seventh bolt can be inserted to prevent boom 7 migrating forward.

The purpose of the two diverging sections of plate is to form a saddle into which different sections of pole 8 may securely rest. A dense plastic material is bonded to the inside face of the saddle which mates upon the pole when assembled.

A retaining tape 25 which is to go around the pole 8 is attached to attachment point 24 on one side of the gooseneck 9. On the other side of gooseneck 9 a fastening point 32 is provided for the retaining tape 25. The purpose of the tape is not only to hold gooseneck 9 snug to pole 8 but also by locating in the slot on the tape 29 along luff 13 to prevent vertical movement of gooseneck 9 on the pole. At this stage the tape is attached to gooseneck 9 attachment point 24 but otherwise left loose.

An alternative approach would be to use fastening point 32 as a guide through which retaining tape 25 passes aft to be tensioned at the clew 10 end of pole 7. Many other designs are also possible.

Many other designs of gooseneck are possible including welded metal fabrications and constructions moulded from plastic, carbon fibre etc. Booms might be constructed with an integral gooseneck. Many different methods of locating the pole at the gooseneck could be employed.

At the clew end of boom 7 a hole is drilled. Lashings are used to attach on each side of the boom one articulated pulley block for control lines 18 and 19 and to provide an eye for a lanyard which is used to tension the clew. The arrangement is capable of accommodating uneven loads. Other examples could provide an end fitting constructed in stainless steel or plastics in similar manner to gooseneck 9 fitting or in the form of a sock with a closed end constructed from spectra tape which fits over the end of the boom. The end fitting should be capable of accommodating the blocks needed for control lines 18 and 19, tensioning lanyard for clew 10 and if appropriate retaining tape 25. One articulated block is attached to each side of the end fitting.

The boom 7 and sail 6 assemblies are brought together by sliding boom 7 gooseneck end first through boom sleeve 17 from clew 10 towards pole sleeve 16. The tape on gooseneck 9 is fed out through the slot 30 on the appropriate side of sail 6, through the slot 29 on the tape along luff 13, back through the second slot 30 in sail 6 and either to the attachment point on gooseneck 9. It is located but not made fast. Likewise the lanyard from clew 10 to the clew end of boom 7 is loosely made up.

This assembly is rolled sail round boom. It could be stowed with the other components of the device perhaps with some lines ready attached perhaps in a valise or case against the time when the emergency rudder is needed.

In preparation for use the assembly described above is unrolled and pole 8 is inserted down pole sleeve 16 such that it protrudes to a suitable extent beneath tack 11.

The vessel's own spinnaker pole is used as pole 8 but other spars might in some cases be suitable such as a whisker pole or a boom or gaff from the mizzen sail of a ketch or yawl. Any suitable spar could be used provided the essential sailing (or motoring) function of the vessel is maintained or regardless of function if the vessel is to be towed. Alternatively a specific spar could be carried for the purpose.

A lanyard is fastened from the loop on tack 11 to the bottom of pole 8. A second lanyard is taken from head 12 to the top of pole 8 returning several times to give a purchase, hauled tight and made fast. Retaining tape 25 is then tensioned and made fast. Next clew 10 is tensioned by means of the lanyard (which returns several times) to the clew end of boom 7 and made fast. All fastenings are then checked for tension and security and adjusted accordingly. The assembled blade 1 is now complete.

The layout of the system and the deployment of blade 1 will now be described and explained by reference to FIG. 3. Two guys 3 and 4 are led through one 25 mm loop at tack 11 round pole 8 and through the other 25 mm loop at tack 11. Guys 3 and 4 are then formed into loops round pole 8 by means of a splice, a bowline or other suitable knot. The size of the loops thus formed is not critical but they are a loose fit around pole 8. Control lines 18 and 19 are fastened to guys 3 and 4 respectively at point P a distance from the tack approximately equivalent to half the length of foot 15. Control line 18 is led through the block near to clew 10 on the starboard side of boom 7 and control line 19 is led through the equivalent block on the port side of boom 7. Tie 2 is fastened to pole 8 at a point sufficiently high for it to be substantially vertical from its proposed attachment point on vessel 28.

In some embodiments of the invention it might be desirable to fasten one or more further ties to pole 8 to share the vertical load and/or restrict the transverse movement of pole 8 at deck level. In many cases it will be convenient to fasten a line to the vessel from head 12 to support blade 1 during deployment.

Tiller 5 is attached prior to deploying blade 1. Tiller ties 21 are attached to suitable points. Ideally three tiller ties 21 are attached at different angles to achieve triangulation and define the position of the pivot of tiller 5.

Guy 3 is brought under the hull of vessel 28 from the stern and on deck over the starboard side. Guy 4 is similarly passed from the stern to the port side. Guys 3 and 4 are then made fast to suitable strong points on the deck of vessel 28, in the current example the sheet winches. In most examples the fastening positions of guys 3 and 4 will not be normally critical and it may for example be satisfactory to make them fast to a foredeck cleat. If the angle is regarded as too shallow then it can be made more acute by an athwartships line joining the two guys 3 and 4. If the lengths of guys 3 and 4 have not been preset then they could be set up temporarily for adjustment after the blade assembly is in the water.

Control lines 18 and 19 are brought from the clew to their respective quarters and through blocks 26 which are located as close as convenient to the quarters of vessel 28. They are then led through further blocks 27 before being fastened to tiller 5. Blocks 27 are positioned so that control lines 18 and 19 make an angle of 15-20 degrees aft towards their point of attachment to tiller 5 in the fore and aft position to minimise the reduction of steering effect as tiller 5 angle increases. The attachment point of control lines 18 and 19 to tiller 5 is chosen to optimise the balance between leverage for the helmsman and adequate range of movement of control lines 18 and 19.

The line from head 12 to vessel 28 is then attached and the blade 1 is lowered into the water. Tie(s) 2 are then attached to vessel 28.

Subject to any adjustment the device is now ready for use. If the various lines have not been preset they should now be adjusted to optimise the geometry. Guys 3 and 4 and ties 2 are altered so that blade 1 is:

on the vessel's centreline;

vertical when viewed from ahead or astern;

vertical when viewed from the side; and located with the head 12 of sail 6 at water level.

None of these features is essential. For example the shape of the vessel might not allow the blade to be on the vessel's centreline. If more than one blade is provided a non-centre-line location and non-vertical position might be preferred.

Control lines 18 and 19 are adjusted so that the slack is just taken up on both with blade 1 and tiller 5 in the fore and aft position.

In the present example of the instant invention there is no need for any direct connection between tiller 5 and blade 1. The only further connection needed between tiller 5 and blade 1 when both are installed is via control lines 18 and 19. Hence the present example of the current invention would still apply even if there are obstructions such as a backstay or mast between blade 1 and tiller 5. Likewise in the case of a centre cockpit yacht tiller 5 could be located in the cockpit whilst still being able to control blade 1 aft of the stern of vessel 28.

It should be noted that most sailing yachts have many strong points which can be used to turn or fasten the various lines which are required for the instant invention in use. In some cases it may be necessary to take lines to remote points and/or use a single point for more than one function. It may also be necessary to re-route some of the various other lines needed to sail the yacht.

The device is now ready for use. Steering of the vessel is the same as the steering of any normal tiller steered yacht.

Moving tiller 5 according to FIG. 3 to starboard simultaneously pulls in the control line 19 and pays out control line 18. Control line 19 tends to move clew 10 to port and simultaneously adjusts the load on guy 4 as it pulls on the length of guy 4 between the hull and the attachment point of control line 19 to guy 4. Thus blade 1 takes up a new position at an angle to the vessel's centreline giving rise to a steering effect and the vessel manoeuvres to port. Moving tiller 5 to port has the opposite effect. Effectively blade 1 behaves as though it had 'balance' as with a conventional rudder which has a fixed pivot point behind its leading edge and conventionally described as a '(semi) balanced rudder'. This balanced behaviour means that loads on the helm are relatively low and control of the vessel is relatively easy.

Numerous variations of the layout described above in addition to those already mentioned are possible.

In the case of the current example of the invention it has been shown that guys 3 and 4 can be fastened in a range of positions along luff 13 without material effect on the function of the device. The preferred position is in the range from just below tack 11 to just below gooseneck 9. In some applications it might be preferable to fasten guys 3 and 4 above tack 11 to reduce the unsupported length of pole 8.

Provision could be made for guys 3 and 4 to be attached to blade 1 prior to stowage and introduction of pole 8. Guys 3 and 4 could be passed through one 25 mm loop, around a luff sock, through the second 25 mm loop and formed into a loop by tying or splicing. When pole 8 is introduced it will be guided inside the loops in guys 3 and 4 by the luff sock in the same way that it is guided through gooseneck 9 tape loop.

Likewise control lines 18 and 19 could be attached to guys 3 and 4 respectively and the lanyards to tack 11 and head 12 could be attached prior to stowage.

Tensioning of sail 6 has been described to be by means of lacing but other means may be appropriate. For example in very large applications a screw tensioner may be preferred. With the particular type of configuration currently under consideration it will always be necessary to tension clew 10 but luff 13 could be tensioned by adjustment on either or both of tack 11 and head 12.

Control lines 18 and 19 could be tethered at any point along guys 3 and 4 or they could be floating—attached either by a block or loop round guys 3 and 4. Alternatively control lines 18 and 19 could act on clew 10 only terminating at clew 10 or on an extended boom 7.

Rather than bringing control lines 18 and 19 straight from clew 10 to blocks 26 on the quarters they could be brought through blocks at or near the top of pole 8 so that steering effect was solely by means of the transfer of the load on control lines 18 and 19 to guys 3 and 4.

If a single fall of control lines 18 and 19 to tiller 5 does not give sufficient range of movement a reverse purchase could be used. Conversely more power could be achieved by a multiple purchase or by bringing the control lines 18 and 19 from clew 10 to the quarter instead of taking them to guys 3 and 4.

It is not essential to operate control lines 18 and 19 by means of tiller 20. On small boats or for a limited time it may be possible to establish satisfactory control by pulling directly on control lines 18 and 19. Alternatively they could be taken to a sheet/halyard winch or anchor windlass or some form of steering wheel.

Connecting control lines 18 and 19 to a single handle which steers vessel 28 by traversing the cockpit may be convenient in some cases.

On yachts with large wheels control lines 18 and 19 could be fastened directly to a spoke or the rim of the ships wheel and the vessel steered in the usual way. Both lines would need to be fastened such that they were hauled in and paid out at the same rate—usually by fastening to the same spoke or together on the rim.

One of many possible alternative methods of blade assembly construction would be to employ two separate booms 7, one from head 12 to clew 10 and one from tack 11 to clew 10. They could be either in sleeves in leech 14 and foot 15 or alongside leech 14 and foot 15. In either case arrangement could be made for booms 7 to be retained at the ends of the tape on luff 13 so that the compression force on booms 7 has the effect of tensioning luff 13. Booms 7 are thereby prevented from diverging.

In such a configuration there may well be a tendency for sail 6 to crease. One method of addressing this problem is to introduce a form of wedge between the ends of booms 7 near to clew 10 on which the tensioning on clew 10 acts such that as clew 10 is tensioned the wedge is drawn in forcing booms 7 apart at clew 10. The diverging force of booms 7 at luff 13 and the effect of the wedge near clew 10 will tension sail 6 both horizontally and vertically by means of the tensioning on clew 10 clew alone.

The invention claimed is:

1. A rudder for a marine vessel including a steering member and a control means wherein said steering member has a steering surface and the control means is attached to the steering surface to effect steering of a vessel to which the rudder is attached by rotation of the steering surface, wherein the rudder further comprises attachment lines attached to upper and lower portions of the steering member at first and second points respectively and arranged such that the steering member is towable from a vessel by the attachment lines and wherein the attachment lines constrain the steering surface to rotate about an axis, so as to steer the vessel, and further wherein said axis of rotation passes through the first and second points.

2. A rudder according to claim 1 wherein said axis is fixed relative to the vessel.

3. A rudder according to claim 1 wherein a pair of attachment lines is attached to said second point and a single attachment line is attached to said first point.

4. A rudder according to claim 1 wherein the attachment lines are attached to the steering surface of the steering member.

5. A rudder according to claim 1 wherein the steering member comprises a frame member, on which the steering surface is mounted, and the attachment lines are attached to the frame member.

6. A rudder according to claim 1 wherein the control means comprises a tiller attached to the steering surface.

7. A rudder for a marine vessel including a steering member and a control means wherein said steering member has a steering surface and the control means comprises control lines attached to the steering surface to effect steering of a vessel to which the rudder is attached by rotation of the steering surface, characterized in that the rudder further comprises attachment lines attached to the steering member and arranged such that the steering member is towable from a vessel by the attachment lines, wherein the attachment lines constrain the steering surface to rotate about an axis, so as to steer the vessel and further wherein first and second control lines are attached to respective sides of the steering surface and are spaced from the axis of rotation of the steering surface such that adjusting the length of the control lines rotates the steering surface about its axis of rotation.

8. A marine vessel comprising a rudder including a steering member and a control means wherein said steering member has a steering surface and the control means is attached to the steering surface to effect steering of the vessel by rotation of the steering surface, wherein the rudder further comprises attachment lines attached to upper and lower portions of the steering member at first and second points respectively and arranged such that the steering member is towed from the vessel by the attachment lines and wherein the attachment lines constrain the steering surface to rotate about an axis, so as to steer the vessel, and further wherein said axis of rotation passes through the first and second points.

9. A marine vessel according to claim 8 wherein said axis is fixed relative to the vessel.

10. A marine vessel comprising a rudder including a steering member and a control means wherein said steering member has a steering surface and the control means is attached to the steering surface to effect steering of the vessel by rotation of the steering surface, characterised in that the rudder further comprises attachment lines which attach the steering member to the vessel such that the steering member is towed from the vessel by the attachment lines and wherein the attachment lines constrain the steering surface to rotate about an axis, so as to steer the vessel and further wherein at least one attachment line is attached from a point on the steering member to a laterally displaced point on the vessel and at least one attachment line is attached from a point on the steering member to an oppositely laterally displaced point on the vessel.

11. A marine vessel comprising a rudder including a steering member and a control means wherein said steering member has a steering surface and the control means is attached to the steering surface to effect steering of the vessel by rotation of the steering surface, characterised in that the rudder further comprises attachment lines which attach the steering member to the vessel such that the steering member is towed from the vessel by the attachment lines and wherein the attachment lines constrain the steering surface to rotate about an axis, so as to steer the vessel and further wherein at least one attachment line is attached from a point on the steering member to a higher point on the vessel and at least one attachment line is attached from a point on the steering member to a lower point on the vessel.

12. A marine vessel according to claim 8 wherein a pair of attachment lines is attached to said second point and a single attachment line is attached to said first point.

13. A marine vessel according to claim 8 wherein the attachment line attached to the first point on the steering member is attached to the vessel, along its centerline, and the attachment lines attached to the second point on the steering member are attached to respective sides of the vessel.

14. A marine vessel according to claim 8 wherein the attachment lines are attached to the steering surface of the steering member.

15. A marine vessel according to claim 8 wherein the steering member comprises a frame member, on which the steering surface is mounted, and the attachment lines are attached to the frame member.

16. A marine vessel according to claim 8 wherein the control means comprises a tiller attached to the steering surface.

17. A marine vessel according to claim 8 wherein the control means comprises control lines attached to the steering surface.

18. A marine vessel comprising a rudder including a steering member and a control means wherein said steering member has a steering surface and the control means is attached to the steering surface to effect steering of the vessel by rotation of the steering surface, characterised in that the rudder further comprises attachment lines which attach the steering member to the vessel such that the steering member is towed from the vessel by the attachment lines and wherein the attachment lines constrain the steering surface to rotate about an axis, so as to steer the vessel and further wherein first and second control lines are attached to respective sides of the steering surface and are spaced from the axis of rotation of the steering surface such that adjusting the length of the control lines rotates the steering surface about its axis of rotation.

19. A marine vessel according to claim 8 wherein the axis of rotation of the steering surface is aligned with the vessel's centerline.

* * * * *